US005358058A

United States Patent [19]

Edlund et al.

[11] Patent Number: 5,358,058

[45] Date of Patent: Oct. 25, 1994

[54] DRILL AUTOMATION CONTROL SYSTEM

[75] Inventors: Hans F. Edlund; Marvin L. Haines, both of Roanoke, Va.

[73] Assignee: Reedrill, Inc., Denison, Tex.

[21] Appl. No.: 127,262

[22] Filed: Sep. 27, 1993

[51] Int. Cl.[5] ..... E21B 44/00

[52] U.S. Cl. ..... 175/24; 175/40; 175/27; 73/151; 364/422

[58] Field of Search ..... 175/24, 25, 26, 40, 175/48, 107; 73/151; 364/422; 417/15; 416/17, 30; 166/53

[56] References Cited

U.S. PATENT DOCUMENTS

| | | | |
|---|---|---|---|
| 4,606,415 | 8/1986 | Gray et al. | 175/24 |
| 4,760,735 | 8/1988 | Sheppard et al. | 73/151 |
| 5,237,540 | 8/1993 | Malone | 175/40 X |
| 5,249,161 | 9/1993 | Jones et al. | 175/40 X |

OTHER PUBLICATIONS

Kennedy, "Computer drilling System can provide optimizatiion, rig control", The Oil & Gas Journal, May 10, 1971, 4 pages.

*Primary Examiner*—Stephen J. Novosad

*Attorney, Agent, or Firm*—David H. Judson

[57] ABSTRACT

A rotary blasthole drilling apparatus comprises a rotary blasthole drill and a drill automation control system. The apparatus includes a pull-down motor and a drill motor. The pull-down motor is driven by a pump to provide a pull-down force to a drill string, and the drill motor is used to provide rotary force to rotate a drill bit of the drill string. The drill automation control system includes a number of functional components including a user interface. Through the user interface, an operator sets a rotary torque set point that determines an amount of torque applied to the drill bit by the drill motor. The control system further includes a detector, for detecting pressure in the pump during a drilling operation, and a processor, which is operative under the control of a program stored therein and responsive to the rotary torque set point and signals from the pull-down pressure sensor for generating an error signal. The error signal is applied to a proportional control valve for modulating the pull-down pressure to provide a substantially constant torque to the system. The rotary torque set point may be varied as a function of one or more of the following external factors: excessive mast vibration, bit air pressure or bit plunge.

2 Claims, 4 Drawing Sheets

DRILL AUTOMATION CONTROL SYSTEM

TECHNICAL FIELD

The present invention relates generally to the control of a drilling machine. More particularly, the invention is directed to systems and methods for optimizing a drilling process using an automated drill operation.

BACKGROUND OF THE INVENTION

Although systems for monitoring drilling are known, these monitoring systems do not provide sufficient information for completely automated control. That is, these systems cannot emulate manual operation of the drilling operation and therefore cannot eliminate the need for manual intervention in the drill control. For example, U.S. Pat. No. 4,760,735 relates to a method and apparatus for monitoring a drilling process by measuring torque applied at the surface to a drill string and by measuring effective torque acting on the drill bit. This information can be accumulated in real time and displayed to the operator to assist the operator in manual adjustment of drilling control.

In a paper entitled "Instrumentation On Blasthole Drills Produces Significant Economic Benefits" by John F. Vynne, Second International Symposium On Mine Planning And Equipment Selection In Surface Mining, Calgary Nov. 1990, a discussion is presented of electronic instruments for use with monitoring rotary blasthole drills. One such device is a drilling efficiency indicator for displaying information (e.g., depth drilled, rate of penetration) to the drill operator. Using this information, the drill operator is able to manually adjust drilling control parameters to improve the drilling operation. Any such information can be recorded to provide on-line monitoring (e.g., indicate if a parameter goes into an "out of limit" condition) and recording during a drilling operation.

Despite the existence of drill control capabilities and the existence of some limited on-line monitoring of drilling parameters, currently monitored parameters do not provide automated drill control which avoids the need for human intervention. Current monitoring systems do not detect parameters which would permit emulated human control of a drilling operation. Accordingly, there is a need to detect parameters which can be measured in real-time for optimizing drill control (i.e., drilling efficiency) without overstressing the machine. Further, there is a need for a completely automated control system which, in addition to optimizing the drill operation itself, anti also reduces or eliminates the potential for human error in all phases of the drill operation (e.g., drill set-up, transport and so forth).

BRIEF SUMMARY OF THE INVENTION

The present invention is directed to systems and methods for fully automating all aspects of rotary drilling to emulate human control. Further, the present invention is directed to systems and methods for reducing or eliminating the potential for human error during all phases of a drilling operation by providing a system of automatic safety interlocks.

In an exemplary embodiment, the present invention relates to methods and systems for automated rotary blasthole drilling comprising a rotary blasthole drill, a movable platform having a pivoting drill string mast for supporting the rotary blasthole drill, the movable platform further including a safety interlock system for detecting predetermined conditions of the drilling apparatus and inhibiting a drill operation when the predetermined conditions are not detected. The safety interlock system further includes a controller for providing automated control of the rotary blasthole drill in response to outputs produced by the safety interlock system and for regulating control of the rotary blasthole drill in response to sensed parameters to maintain a predetermined torque on the drill using a proportional-integral-derivative ("PID") feedback control loop.

In accordance with the preferred embodiment of the invention, a rotary blasthole drilling apparatus comprises a rotary blasthole drill and a drill automation control system. The apparatus includes a pull-down motor and a drill motor. The pull-down motor is driven by a pump to provide a pull-down force to a drill string, and the drill motor is used to provide rotary force to rotate a drill bit of the drill string. The drill automation control system includes a number of functional components including a user interface. Through the user interface, an operator sets a rotary torque set point that determines an amount of torque applied to the drill bit by the drill motor. The control system further includes a detector, for detecting pressure in the pump during a drilling operation, and a processor, which is operative under the control of a program stored therein and responsive to the rotary torque set point and signals from the pull-down pressure sensor for generating an error signal. The error signal is applied to a proportional control valve for modulating the pull-down pressure to provide a substantially constant torque to the system. The rotary torque set point may be varied as a function of one or more of the following external factors: excessive mast vibration, bit air pressure or bit plunge.

BRIEF DESCRIPTION OF THE DRAWINGS

Other objects and advantages of the present invention will become more apparent from the following detailed description of preferred embodiments when read in conjunction with the accompanying figures wherein.

DETAILED DESCRIPTION

Exemplary systems and methods for automated drilling with a rotary blasthole drill will now be discussed in detail. After providing a detailed discussion of exemplary systems and methods of the present invention, an exemplary drilling operation will be discussed.

Although reference is made herein to hydraulic and/or pneumatic control, it will be apparent to those skilled in the art that the present invention can also be applied to an all electric system, an all hydraulic system, an all pneumatic system or any hybrid combination. It will also be appreciated by those skilled in the art that although the exemplary embodiments described herein relate to the use of a rotary blasthole drill, aspects of the present invention are readily adaptable to all conventional forms of borehole drilling.

Exemplary embodiments of the present invention are directed to blasthole drilling using automated control which emulates manual operation of a conventional system. Unlike conventional automated drilling processes which focus on optimizing the rate of drilling penetration to decrease the cost per hole (i.e., without regard to bit life or blasting efficiency), the present invention is directed to optimizing drill control and blasting efficiency so that increased fragmentation of the rock in the borehole will prolong bit life and improve ease of transporting fragmented rock from the drilling site. Optimized drilling and blasting efficiency is derived from knowledge of the strata which is obtained from parameters monitored in real time during the drilling process. For example, to permit efficient automated blasthole drilling in accordance with the present invention, specific energy expenditure is monitored and used to optimize the life of the drill bit and to increase blasting efficiency.

In accordance with the present invention, the specific energy which is expended during the drilling process is calculated as the energy used per unit volume of the borehole drilled (as expressed, for example, using in-lbs/in3). A high value of specific energy reflects a decreased efficiency during the drilling operation, and is used in accordance with the present invention to modify the ongoing blasting operation (i.e., used by the operator to pack the borehole with explosives). Further, control set points are also established by the operator for optimizing specific energy during the drilling operation. For example, the speed of the rotary drill can be set at a fixed value by the operator, and torque set points can be used to automatically adjust the drill operation via a plurality of feedback loops. Exemplary systems and methods in accordance with the present invention will now be described in greater detail.

Figure 1:
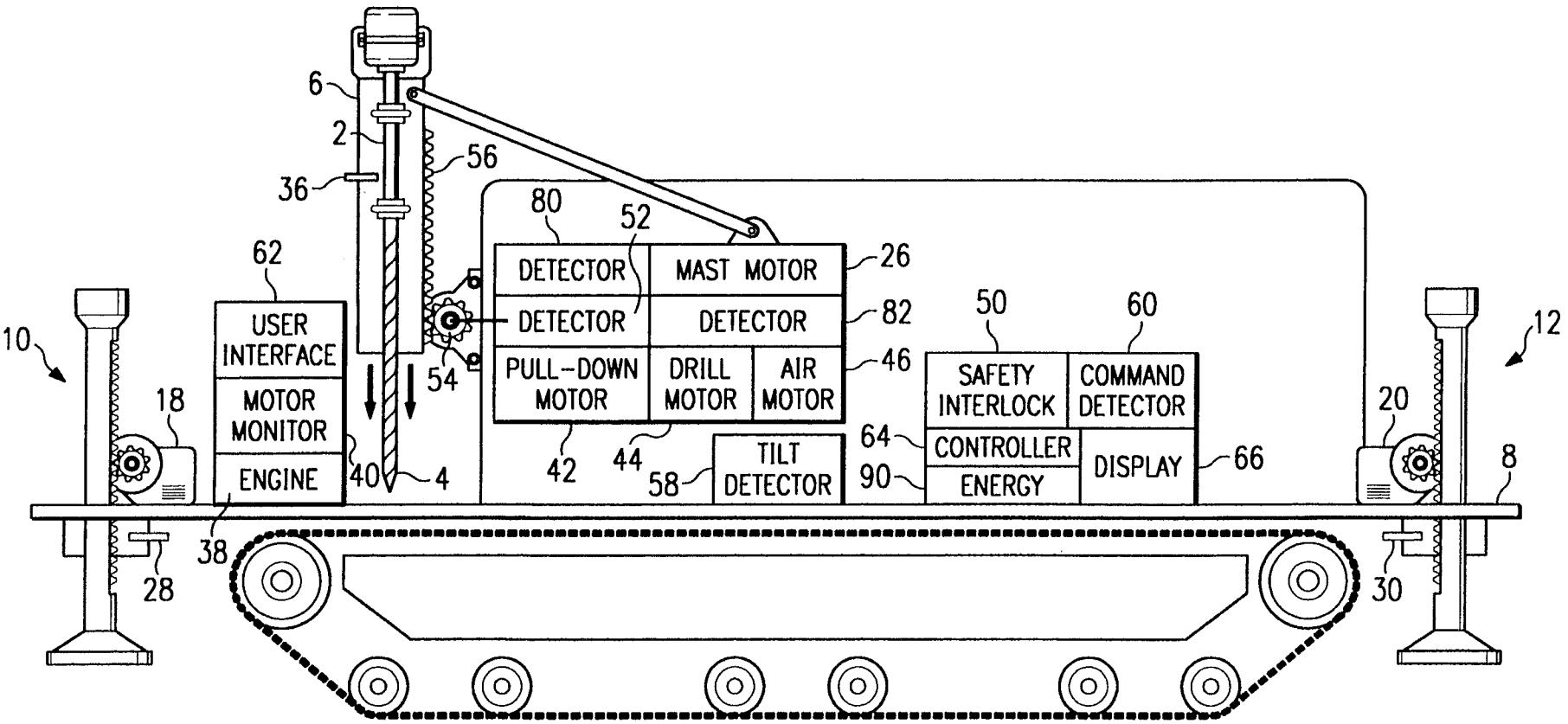
FIG. 1 is an exemplary illustration of an apparatus in accordance with the present invention.

FIG. 1 illustrates an apparatus for an automated rotary blasthole drill which includes a tool string 2 having a rotary blasthole drill bit 4. The tool string 2 is supported within a pivoting drill string mast 6 which is supported on a movable platform 8.

During tramming of the rotary blasthole drill to a work site, the drill string mast 6 is typically (but need not be) pivoted into a horizontal position (not shown in FIG. 1). Upon arrival at a work site, the drill string mast is pivoted into the vertical position shown in FIG. 1 so that the rotary blasthole drill can be activated for a drilling operation.

The movable platform 8 further includes stabilizers for leveling the movable platform with respect to the ground. In FIG. 1, two of four stabilizers 10 and 12 are shown. Each of the four stabilizers is independently driven by a motor (e.g., motors 18 and 20). In an exemplary embodiment, each of the stabilizer motors is a hydraulic motor. Similarly, a hydraulic motor 26 can be used to pivot the drill string mast between its horizontal position and its vertical position. However, those skilled in the art will recognize that any suitable motor, such as a pneumatic or electric motor can also be used for independently controlling the stabilizers and/or the drill string mast.

Engaging pins 28 are provided for each of the stabilizers illustrated. Each of the engaging pins essentially consists of a lock for holding the stabilizer in an extended position upon completion of a leveling operation, and a lock position for holding the stabilizer in a retracted position prior to tramming of the movable platform 8. Further, an engaging pin 36 is provided for locking the drill string mast in an operable vertical position shown in FIG. 1.

Alternatively, the stabilization jacks are operated by a hydraulic pump and a valve bank instead of a motor. In such case, the stabilizer jacks are held in place through a load check valve instead of an engaging pin. The load check valve keeps hydraulic oil static in a supply line, and the only way to move the oil is by a circuit controlled from the valve bank.

A drive means 38 represents an engine for transporting the movable platform 8 from one site to another. The drive means can, for example, be a conventional diesel or gas engine. A monitoring means 40 is provided with the movable platform for monitoring conditions of the drive means 38 as well as conditions of each of the stabilizer motors and the drill string mast motor. Further, the monitoring means 40 monitors an additional pull-down motor (e.g., hydraulic motor) 42 and a drill motor 44 (e.g., hydraulic motor). The pull-down motor 42 is used to provide a pull-down force to a cross-bar attached to the drill string, the cross-bar being operably driven downward via a rack and pinion to apply pull-down pressure to the drill string 4 during a drilling operation. The drill motor 44 is used to impart rotary force to the rotary blasthole drill 4 to rotate a drill bit of the rotary blasthole drill.

The monitoring means 40 also monitors conditions of a pneumatic motor 46 which imparts air through the tool string 2 and out holes in the rotary blasthole drill 4. The purpose of providing air through the drill 4 is to clear chips of fragmented strata from the vicinity of the drill bit, as well as to cool the drill bit. Details of the aforementioned hydraulic and pneumatic motors are conventional, and for purposes of the following discussion need not be described in great detail.

The FIG. 1 apparatus further includes a safety interlock system for detecting predetermined conditions of the drilling apparatus. The safety interlock system can be used to, for example, inhibit a drilling operation when predetermined conditions are not detected. For this purpose, the safety interlock system, as generally illustrated by element 50 in FIG. 1 includes a mast position detecting means 52.

The mast position detecting means 52 is, for example, a conventional position encoder for measuring the rotation of a rotating gear 54 on the mast used to impart the pull down force to the drill string via a rack 56 which is operably engaged with the rotating gear 54. The mast position detecting means also includes an encoder for detecting vertical movement of the mast. By detecting position of the mast relative to the movable platform 8, the position of the drill bit in the ground can be accurately monitored during a drilling operation. The mast position detecting means can also include a detector to sense when the mast is in its vertical position as shown in FIG. 1 and when the mast is in its horizontal tramming position.

A tilt detecting means 58 is located in an approximate central location of the platform (i.e., center of gravity of the platform) for sensing overtilt of the platform in at least two axes. The tilt detecting means can, for example, be a conventional accelerometer for detecting overtilt of the platform in the x and Y axes of the platform as shown in FIG. 1.

An operator command detecting means 60 is also provided in conjunction with a user interface 62, a controller 64 and a display 66 for detecting commanded conditions of the user interface. For example, the operator command detecting means senses whether a drill mode has been selected by the operator. This information is used by the safety interlock system 50 to inhibit or enable various operations only when predetermined conditions exist. Those skilled in the art will recognize that any or all of the monitoring means 40, safety interlock 50, command detecting means 60, user interface 62, controller 64 and display 66 can be combined into a single unit and controlled by a master controller (e.g., master programmable logic unit, or PLU, digital processor having a control program stored or loadable therein or personal computer).

Figure 2:
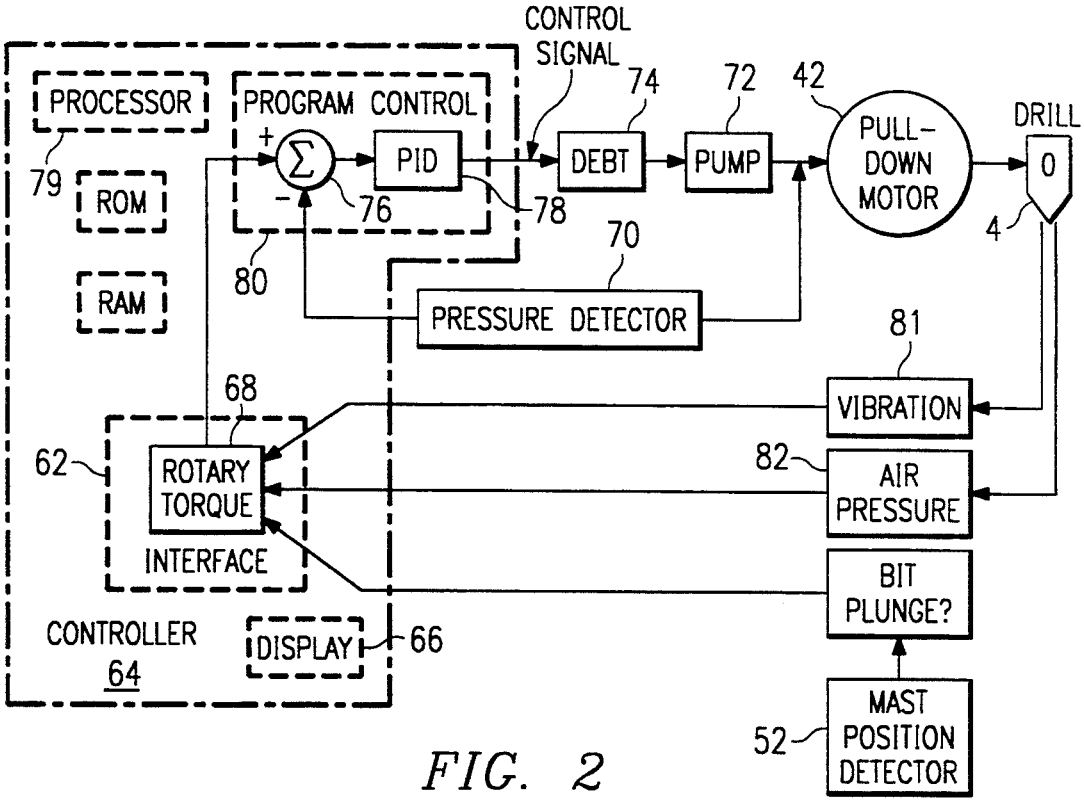
FIG. 2 is a control diagram showing the preferred PID feedback control loop of the present invention for use in modulating pull-down pressure in the apparatus of FIG. 1.
Figure 3:
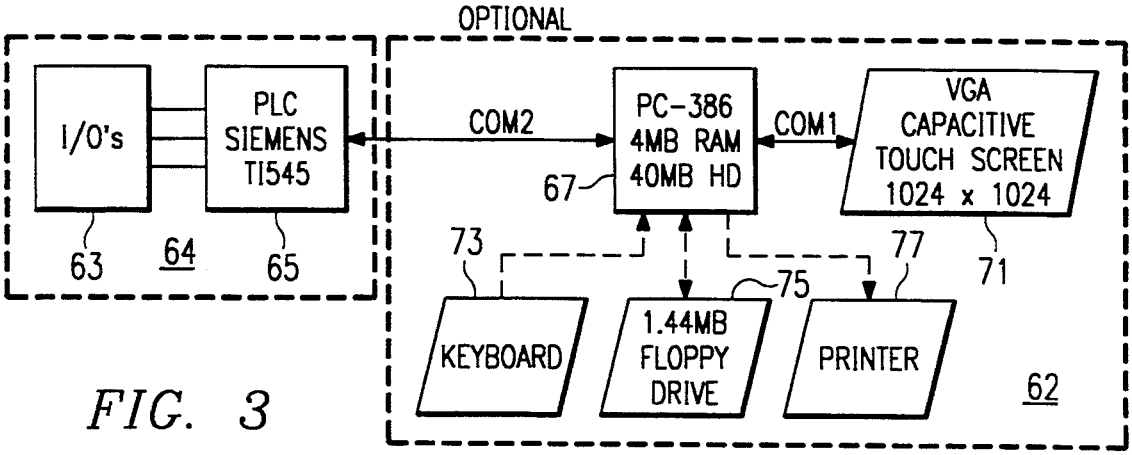
FIG. 3 illustrates a block diagram of a controller for use in accordance with the present invention.

The FIG. 1 system includes the controller 64 for providing automated control of the rotary blasthole drill operation. In the preferred embodiment as will be discussed below, the controller operates to modulate the pull-down pressure according to a feedback control loop wherein rotary torque of the drill motor 44 is a setpoint for the control loop and pull-down pressure is the process variable for the loop. Features of the controller 64 are illustrated in greater detail in FIG. 2. In FIG. 2, the controller 64 is shown to include an input-/output section 63 and a master controller, represented in FIG. 3 as a Siemens TI 545 processor, which is merely exemplary. The user interface 62 of FIG. 1 is illustrated in FIG. 3 to include, for example, an independent processor 67 with associated RAM and ROM memory, a capacitive touch screen (e.g., 1024 × 1024) 71, a keyboard 73, a floppy disk drive 75 and a printer 77. Other known I/O devices, such as a windows-based graphical user interface ("GUI") and point and click device, voice recognizer, penwriter, etc, can be used in place of the screen and keyboard. The particular user interface is not critical providing appropriate devices are included to enable the operator to enter certain input information (e.g., rotary torque set point) and to be informed of system output information.

It is desirable (although not required) to use the controller 64 to provide automated control of the drill operation in response to outputs produced by the safety interlock system 50. To provide automated control of the rotary blasthole drill in response to outputs produced by the safety interlock system, the safety interlock system 50 is connected to each of the mast position detecting means 52, the tilt detection means 58, the operator command detecting means 60, the user interface 62, the various drive means, the monitoring means 40 and, all engaging means (e.g., stabilizer and mast pins). For purposes of the exemplary embodiments described herein, the safety interlock will be described with two general modes of operation: a drilling mode and a tramming mode.

The controller 64 preferably permits an operator to select a drilling mode of operation via the user interface 62 (e.g., touchscreen 71) only if the safety interlock system 50 has detected that the mast 6 is in its upright, vertical position and mast engaging pins 36 (which includes two mast lock pins) are engaged. Further, preferably the safety interlock system must detect that the FIG. 1 apparatus is level via feedback from the tilt detecting means 58. Although these are two important features which preferably must be detected to permit drilling, it will be readily apparent to those skilled in the art that other conditions can be designed as prerequisites to the drilling operation. For example, the controller can be programmed to require that the safety interlock system detects release of drill head brake typically used to ensure that the drill string can be moved downward.

Preferably, the controller 64 also inhibits a user selection of a tramming mode if the safety interlock system 50 does not detect predetermined conditions. For example, in order to tram the drill 4 from one site to another, the safety interlock system must detect that the jacks of the four stabilizers are in their retracted state, that a tram brake is released, that the drill head brake is engaged and that the drill bit 4 is retracted from the borehole (e.g., via the mast detecting means detecting that the drill string has been retracted by a distance previously advanced. As with the drilling mode, it will be readily apparent to those skilled in the art that any conditions which are considered significant to a tramming operation can be detected and used as a prerequisite to initiating a tramming operation.

Other safety conditions can be monitored and used to mitigate the possibility of human error and prolong the life of the FIG. 1 apparatus. For example, the controller 64 can be used to monitor all aspects of the various drive means included in the FIG. 1 apparatus, including compressor oil temperature of any compressor used to drive the pneumatic motor 46 (of any other pneumatic motors), coolant temperature in any or all of the drive means, coolant level in any or all of the drive means, hydraulic fluid level in any or all of the drive means, engine pressure conditions, compressor pressure conditions and so forth. The controller 64 can, for example, respond to any or all of these conditions and inhibit activation of a fuel solenoid so that the main drive engine used for the FIG. 1 apparatus cannot be started during a tram mode or a drill mode unless all conditions have been satisfied. Further, any or all of these conditions can be used to shut down the main drive means at any time during operation. In all cases, an option can be provided to the operator to override any such shutdown condition.

An autoleveling system which is used to establish and maintain a level condition for the movable platform 8 can be considered part of the safety interlock system, as the autolevel system can be used to inhibit or discontinue drilling if an out-of-level condition is detected. To establish a level condition for the platform, actual pressure in each of the stabilizer motors can be detected and used to adjust a position of a jack in each stabilizer. To establish a level condition during set-up for a drilling operation, a pressure increase above a set point in each stabilizer motor can be used as an indication that the jack has initially contacted the ground after a metering of fluid has been used to lower the jack toward the ground. The display means 66 can be used to illustrate to the operator which jacks are being operated and, if desired, which way the platform is leaning. Outputs from the tilt detecting means 58 can be used to control the jacks in a servo-loop until the output from the tilt detecting means in both axes is below a predetermined limit set by the operator.

More particularly, upon arriving at a drill site, an auto-levelling is initiated as a function of which corner is low. For example, assume the right rear is low. The auto-leveling is thus initiated by lowering a right rear jack until a pressure set point associated with the jack indicates that the jack has contacted the ground. Afterwards, the left rear jack extends until it contacts the ground. Next, the two front jacks are extended until pressure set points are exceeded, thus indicating that they also have contacted the ground. Subsequently, using the output of the tilt sensor 58, an auto-levelling function is performed in two axes. Once all four jacks have contacted the ground, any tilt error in the x axis can be used to compensate to level the platform. Afterwards, any tilt error in the y axis can be used to compensate the platform to level it in the y direction. The tilt sensor 58 then continuously monitors tilt in 360° to detect overtilt conditions. Any overtilt of 6° will cause the auto-leveling operation to cease as a result of an abnormal condition dictating operator intervention.

As noted briefly above, the present invention utilizes the controller 64 to modulate pull-down pressure according to a feedback control loop wherein rotary torque of the drill motor 44 is a setpoint for the control loop and pull-down pressure is the process variable for the loop. This operation provides significant advantages over the prior art and is shown diagrammatically in FIG. 2. The control loop uses rotary torque as a setpoint for the loop and pull-down pressure and the loop process variable. In particular, the loop comprises a rotary torque set point 68. Typically, the rotary torque set point is input by the operator via the user interface 62. Pull-down pressure of the pull-down motor 42 used for pull-down control is monitored via a pull-down pressure detector 70. The pull-down motor is actually controlled by a pump 72, whose stroke is in turn controlled by a proportional control valve DBET 74. Proportional control valve DBET 74 receives a control signal input generated by the control loop.

In particular, the rotary torque set point is input to a summer 76, which also receives the pull-down pressure sensed by the detector 70. The output of the summer 76 is supplied to a proportional-integral-derivative ("PID") algorithm 78, which generates the control signal applied to adjust the proportional control valve DBET 74. A processor 79 is operative under the control of the program 80 for generating the control signal. Thus, the control loop provides a feedback control for driving the valve 74 and thus the pump 72 to maintain the rotary torque at the set point.

In the preferred embodiment, the rotary torque set point may be predetermined or established by the operator based on expected specific energy requirements associated with drilling strata known to exist at the drill site. This value may be selectively varied by the controller as a function of one or more external factors such as vibration, bit air pressure, or bit plunging. Thus, for example, the control loop includes a vibration detecting means 81 for detecting vibration of the drill string. The vibration detecting means can, for example, be an accelerometer for measuring vibration limits of the drill head. When the vibration level exceeds a predetermined limit, the torque set point 68 is lowered to decrease power output of the machine. As the power output of the machine is reduced, the vibration level is reduced. However, if the vibration level drops, the torque set point 68 is again increased.

The amount by which the torque set point is increased or reduced as a function of the vibration detected can be experimentally determined. Below a predetermined maximum vibration limit, a linear relationship between vibration and torque set point can be used such that if the vibration is 20% above a set point, the torque set point is decreased 20%.

The rotary torque set point 68 can also be varied as a function of bit air pressure. For this purpose, the control loop includes an air pressure detecting means 82 for detecting air pressure applied to the drill string during a drilling operation. In a normal drilling mode, the controller 64 automatically turns on the compressor to push air through the drill string 2 and out holes in the rotary blasthole drill 4. Air flow is approximately 3,000 to 5,000 feet/minute to blow chips out of the hole and avoid energy loss due to cutting the rock into fine dust. The air pressure is also used to avoid bit plugging which results in unnecessary energy expenditure.

The air pressure detecting means is used to adjust the torque set point 68 using, for example, an experimentally determined relationship between the two. An increase in air pressure above a predetermined, experimentally determined limit can be used as an indication of drill bit plugging. If drill bit plugging is detected, the pull down force, which is typically constant during the drilling mode, can be decreased to move the drill in a direction away from the borehole. Once the plugging condition has been removed, the pull down torque set point can be restored to its original, fixed value. Thus, damage to the drill bit is limited.

More particularly, if the air pressure is determined by the controller to exceed a predetermined limit (e.g., greater than 60 psi but less than 80 psi), the torque set point is modulated. In an exemplary embodiment, this modulation has a linear relationship. Beyond the maximum value (e.g., the 80 psi limit), the controller 64 would discontinue drilling and back the drill off the rock entirely.

The control loop may also respond to bit plunge in order to vary the rotary torque set point. In particular, the mast position detecting means 52 used to detect the position of the mast (and used to detect the position of the tool string in the borehole) can also be used as a drill advance detecting means for sensing a rate of drill string advance in the drilling direction. By detecting the rate of advance of the drill, bit plunging can be detected. Bit plunging refers to a condition where loose rock or soil is encountered by the drill, and the drill quickly advances through the strata. Such bit plunging can result in damage to the bit if, as a result of a bit plunge, the bit impacts a subsequent hard stratum with a great amount of force. If a rate of advance above a preset, experimentally determined limit is detected, the controller automatically reduces the rotary torque set point 68 until an indication is received by the controller that a solid stratum has been again encountered by the drill. If a bit plunging condition is detected, the operator can manually advance the bit until rock is encountered (as detected by rate of advance) and then reactivate the drilling process.

Thus, any one or more of such external factors may be used to modify the rotary torque set point. In all cases, however, it is preferred to use the pull-down pressure is the loop process variable. The feedback control loop operates to modulate the pull-down pressure to insure that the rotary torque set point (as originally set or as modified by one or more of the external factors) remains constant throughout the drilling operation.

As used herein, bit load typically refers to the force applied to a drill string and encompasses loading due to the drill string including weight of the drill string. Pull-down pressure, although similar to bit load, does not include the weight of the drill string. Rather, cogs which run up and down sides of the mast apply force to the drill string in a vertical, downward direction. Hydraulic pull-down pressure, or torque, corresponds to the pull-down load on the hydraulic motor 42 used for applying pull-down pressure to the drill string.

The feedback control loop shown in FIG. 2 is useful both in a collaring mode of operation and a drilling mode of operation. During a collaring mode, the drill is operated at a decreased rpm to create a mud collar which stabilizes the mouth of the borehole. During this mode, the controller 64 automatically controls dispersement of water around the drill 4 to create the mud collar. Thus, any need for concrete collars around the opening of the borehole is unnecessary. The reduced speed at which the drill operates can be established as a predetermined fixed speed which is a set amount below the preset rotary drilling speed established by the operator via the user interface 62. In order to provide a display of drill speed via the user interface display 66, a drill speed detecting means is also preferably provided. Upon completion of a drilling to a predetermined collar depth, the collaring mode is automatically deactivated, thus turning the water off. During a drilling mode, the drill is operated at a preset, fixed rotary speed. Preferably, there are several selectable speeds (e.g., 75 rpm and 150 rpm).

Collaring and drilling operations use the same feedback control loop. The only difference in operation is that the rotation starts first in collaring and then the pull-down control (using the feedback loop) is activated a predetermined time (e.g., 5 seconds) later. In the drilling mode, the rotation and pull-down start at the same time.

The object of the drill control mode is to provide constant torque and power to the drill bit. Using the feedback loop to measure an error between the rotary torque set point and the pull-down pressure, the pump stroke is selectively controlled by the DBET valve to result in optimum efficiency during the drilling process. In a simple case, this can be a linear relationship, or it can be an experimentally determined relationship. Preferably the PID 78 is a velocity form of the PID algorithm, although the position algorithm may be used as well. The details of the position and velocity PID equations are provided in the SIMATIC TI505 Programming Reference Manual, Section 9.3, which is incorporated herein by reference.

A drilling operation thus may involve use of the controller 64 to continuously monitor hole depth, rotary head location (i.e., bit location), bit air pressure, vibration, rotation speed and jack pressure for one or more of the stabilizers of the movable platform. The hole depth and rate of advance of the bit are monitored to detect bit plunging. As mentioned above, the rotary torque set point is automatically decreased if bit air pressure exceeds a predetermined limit, and an automatic decrease in rotary torque in turn decreases the pull-down force until the bit clears itself. However, if pressure continues to increase, the controller 64 lifts the bit off of the hole bottom as described above. Thus, bit air pressure is used as feedback to automatically reduce the torque set point for the rotary torque applied to the drill. Similarly, vibration is monitored and used to decrease the rotary torque set point when vibration exceeds a preset limit.

As mentioned above, user interface 62 is provided for the FIG. 1 apparatus. The user interface includes the aforementioned control panel for selecting operating modes of the apparatus (e.g., the collaring mode or the drilling mode). The user interface also includes a suitable display means 66. The display means displays drilling and tramming conditions of the safety interlock system as well as selected operating modes of the apparatus and parameters monitored during operation of a selected mode.

A feature displayed to the operator in accordance with the present invention is the specific energy consumed by the FIG. 1 apparatus during a drilling operation. For this purpose, an energy detecting means 90 is included in the controller 64 for sensing energy consumption during a drilling operation as a function of rotary speed of the drill and torque on the drill. The energy consumed is proportional to power, which in turn is proportional to the product of multiplying the drill speed and the rotary torque on the drill. The controller 64 is responsive to the rate of drill string advance and to the energy consumption calculated as described above for determining the specific energy as a measure of drilling efficiency.

This specific energy can be used by the operator as an indication of drilling efficiency and can be used by the operator to alter the amount of blasting performed in the hole in order to optimize the drilling process even further. For example, where the drilling efficiency is relatively low, as reflected in a relatively high specific energy, increased blasting in the borehole can be performed to break up relatively dense rock structures. Further, the specific energy can be used as a measure of seams in the borehole between layers of the strata being drilled.

The display means 66 can also be used to display monitored parameters including the drill's rotary speed, any of the drill set points, the sensed rotary speed of the drill, sensed vibration, sensed rotary pressure or feed-down pressure, sensed rate of drill advance, all temperature and pressure values of all drive systems, hole depth, rotary drill head location, control parameters (e.g., bandwidth, gain and so forth) of the PID control loop used for pull-down control pressure command, and so forth. The display 66 also includes displays such as fuel level, engagement condition of all engaging pins, and audible/visible alarm and other enunciated functions, drill penetration rate and so forth. Any information input to or monitored by the user interface can be collected and stored. Further, any such information can be wirelessly transmitted to a base station or transferred to any suitable storage device using conventional transmission techniques.

The user interface also includes the aforementioned touch sensitive screen located in a cab on the movable platform. The touch sensitive screen enables the operator to start the engine of the movable platform as well as the motors used to drive all features of the aforementioned system. The touch sensitive screen also enables the operator to perform drilling functions and leveling functions.

The system is set to automatically archive data on each of hole depth, specific energy, penetration rate, bit load, torque, borehole pattern, borehole ID bit ID used for drilling and time. Alarms which can be audibly and/or visually provided to the user include cooling alarms, overheating alarms, pressure alarms and so forth.

Figure 4A:
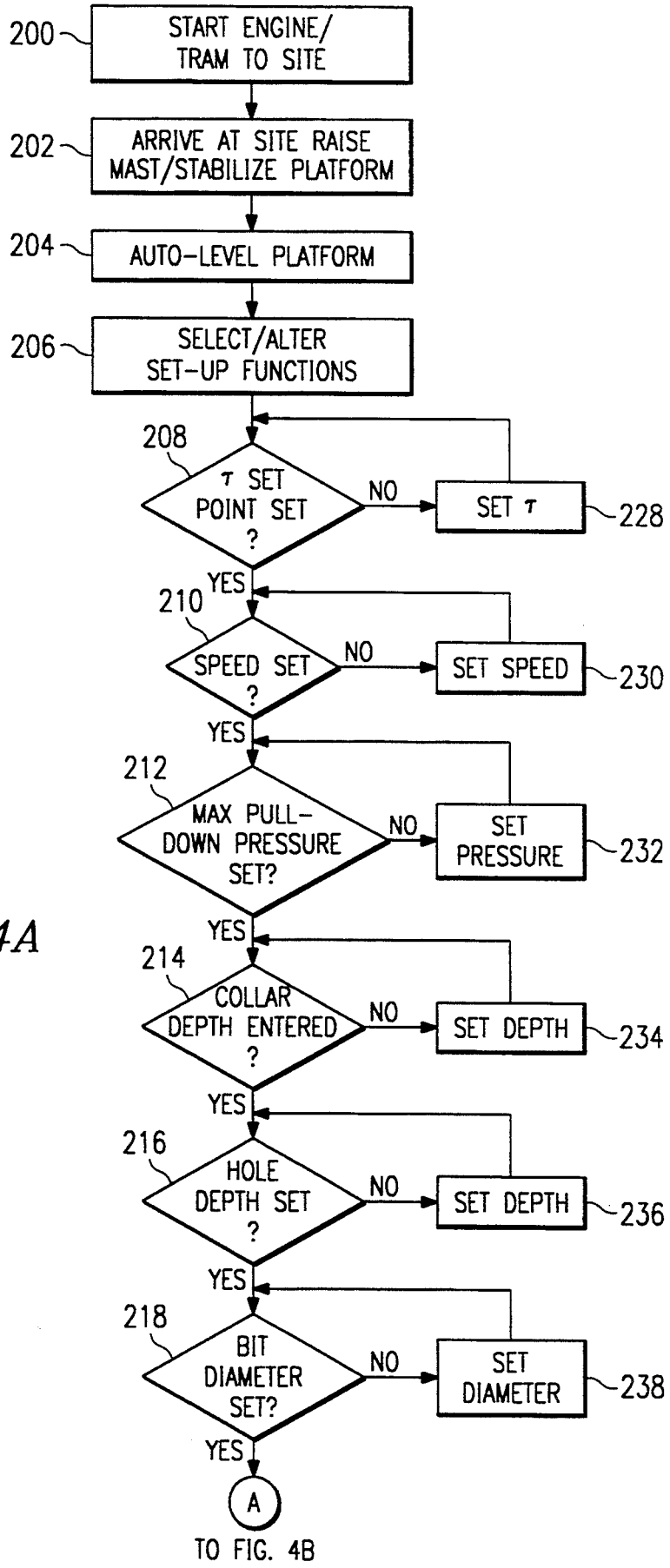
FIGS. 4A–4C represent a flowchart of an exemplary operation using the FIG. 1 apparatus.

Operation of the FIG. 1 system for use at a particular site to be drilled will now be described with respect to the FIG. 4 flow chart. Referring to FIG. 4A, an exemplary system operation for performing a drilling operation in accordance with the present invention is illustrated.

Initially, the FIG. 1 movable platform is trammed to a drilling site (block 200). In block 202, the mast is raised and the platform is stabilized by lowering the jacks to contact the ground. In step 204 the platform is automatically leveled as described above.

In block 206, a system setup is performed in response to operator selections. These setup parameters include rotation speed of the drill bit, the torque set point, vibration limit, collar depth, hole depth, bit and borehole identifications, pull-down limits, air pressure limits and so forth. These various setup functions must be completed before a drilling operation can be initiated. The requirement that all necessary parameters be established by the operator prior to a drilling operation is reflected by the decision blocks 208, 210, 212, 214, 216, 218, 220, 222, 224 and 226. One or more of these parameters may be skipped. Verification blocks 228, 230, 232,234, 236, 238, 240, 242, 244 and 246 are also illustrated for each of these set-up functions.

Figure 4B:
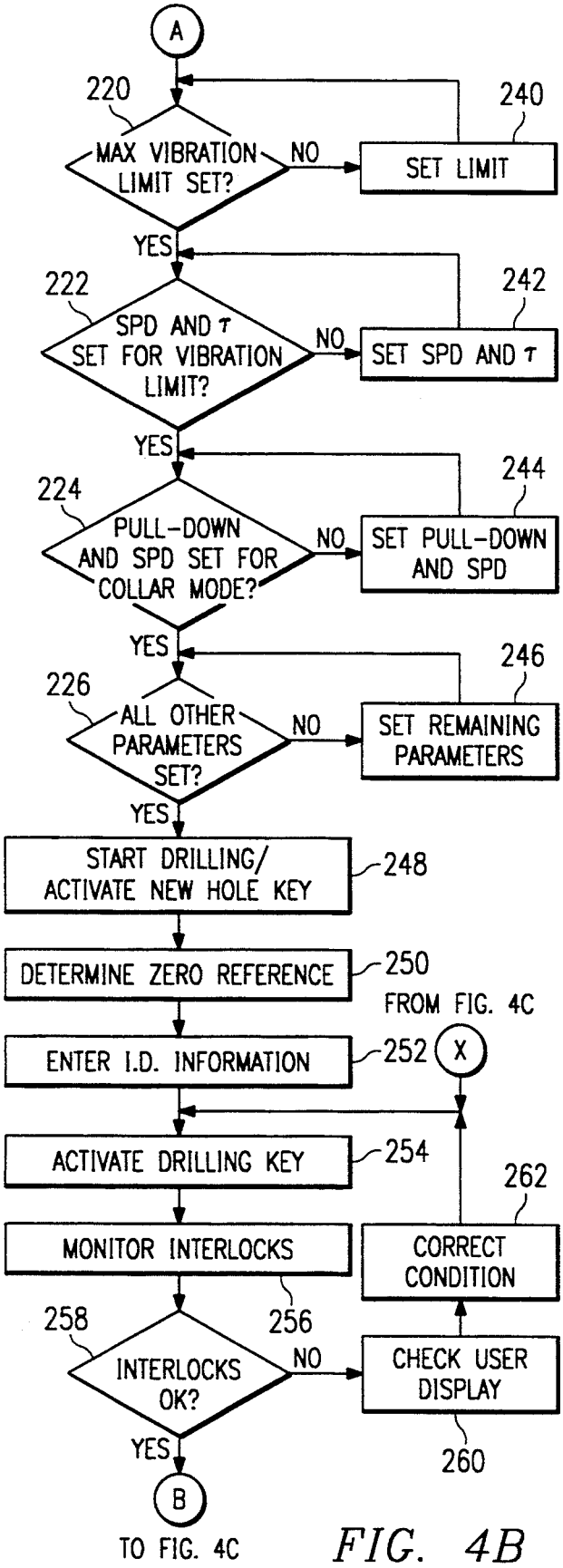
Figure 4C:
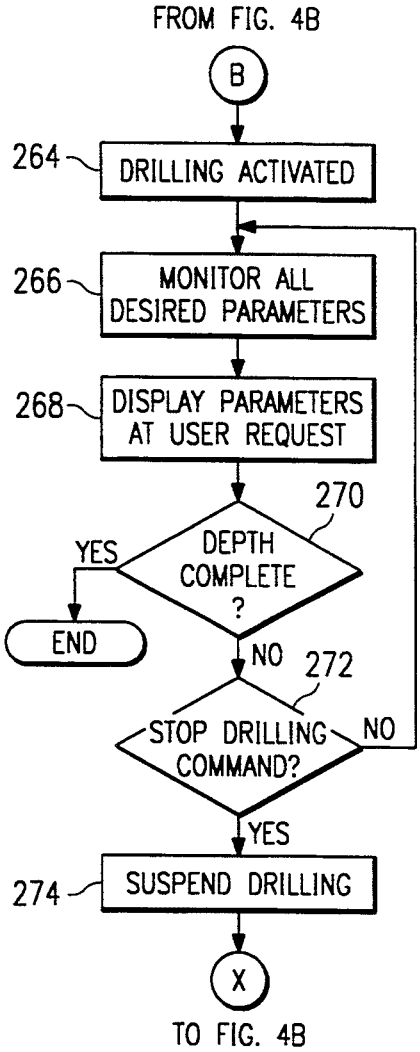

Unless all setup parameters have been established, as reflected by a yes decision from the output of decision block 226 in FIG. 4B, the operator cannot initiate a drilling operation by activating a new borehole key on the user interface (block 248). Of course, one or more of these setup parameters may be omitted if desired. When a drilling operation can be initiated, the system determines a zero reference for the drill bit in block 250 and requests that all identification information regarding drill bit, borehole number and user ID be entered at block 252.

Drilling is activated in block 254 via a key on the user interface and all interlocks are monitored prior to initiation of the drilling operation in block 256. Decision block 258 and status blocks 260 and 262 generally reflect the continuous monitoring of all safety interlock conditions both before actual drilling begins as well as during the entire drilling process. Assuming all interlocks are in an ok condition, drilling modes (i.e., a collaring mode and a drilling mode) can be activated and continued in block 264 of FIG. 4C.

Block 266 indicates that all parameters described previously are continuously monitored and selectively displayed to the user. As mentioned, all or any of the monitored parameters can be displayed for the user as indicated in block 268. Block 270 reflects a continuous monitoring of hole depth such that drilling continues assuming the operator has not manually activated a stop drilling command in decision block 272.

Assuming the hole depth is not complete and the operator has not commanded a stop condition, all parameters are continuously monitored and selectively displayed (blocks 266 and 268). However, if the user has requested a manual stop of the drilling (e.g., specific energy indicates that drilling is not optimized such that a repacking of the borehole or modified blasting of the borehole is necessary), a stop drilling command is applied to the system to suspend drilling in block 274. Once drilling is suspended, it can only be reactivated via activation of the drilling key in block 254.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. In a rotary blasthole drilling apparatus comprising a rotary blasthole drill having a pull-down motor driven by a pump to provide a pull-down force to a drill string and a drill motor to provide rotary force to rotate a drill bit of the drill string, the improvement comprising:

means for setting a rotary torque set point that determines an amount of torque applied to the drill bit by the drill motor;

means for detecting pressure in the pump during a drilling operation; and processor means, operative under the control of a program stored therein and responsive to signals from the setting means and the detecting means for generating an error signal; and means responsive to the error signal for adjusting a stroke of the pump.

2. A rotary blasthole drilling apparatus, comprising:

a rotary blasthole drill having a pull-down motor driven by a pump to provide a pull-down force to a drill string and a drill motor to provide rotary force to rotate a drill bit of the drill string; and a drill automation control system comprising:

means for setting a rotary torque set point that determines an amount of torque applied to the drill bit by the drill motor;

means for detecting pressure in the pump during a drilling operation; and processor means, operative under the control of a program stored therein and responsive to signals from the setting means and the detecting means for generating an error signal; and means responsive to the error signal for adjusting a stroke of the pump.

* * * * *